United States Patent [19]

Sigg et al.

[11] Patent Number: 4,726,298

[45] Date of Patent: Feb. 23, 1988

[54] CONNECTION BETWEEN THE CASING AND THE REAR PART OF A SABOT FOR PROJECTILE

[75] Inventors: Hanspeter Sigg, Jestetten, Fed. Rep. of Germany; Harald Katzmann, Neuenhof, Switzerland

[73] Assignee: Werkzeugmaschinenfabrik Oerlikon-Bührle, Zürich, Switzerland

[21] Appl. No.: 17,843

[22] Filed: Feb. 24, 1987

[30] Foreign Application Priority Data

Mar. 7, 1986 [CH] Switzerland ..... 00951/86

[51] Int. Cl.[4] ..... F42B 13/16

[52] U.S. Cl. ..... 102/523; 102/527

[58] Field of Search ..... 102/520–527

[56] References Cited

U.S. PATENT DOCUMENTS 2,996,012 8/1961 Butler ..... 102/527
3,786,760 1/1974 Feldmann .

FOREIGN PATENT DOCUMENTS 72584 2/1983 European Pat. Off. ..... 102/522
3142636 5/1983 Fed. Rep. of Germany .
1576031 7/1969 France .

*Primary Examiner*—Harold J. Tudor
*Attorney, Agent, or Firm*—Werner W. Kleeman

[57] ABSTRACT

Ever greater demands in terms of mechanical strength and gas tightness are being made on the connection between the rear part and the casing of a sabot for a projectile. To improve this connection a circumferential groove is provided in the rear part of the sabot into which protrudes a rotating band of the sabot casing which band contacts the barrel rifling to spin or rotate the projectile. The circumferential groove and the rotating band anchored therein exhibit a dovetailed cross-section which prevents the rotating band from slipping out of the circumferential groove. The rotating band is linked to the casing via a predetermined break point.

3 Claims, 2 Drawing Figures

CONNECTION BETWEEN THE CASING AND THE REAR PART OF A SABOT FOR PROJECTILE

BACKGROUND TO THE INVENTION

The present invention relates to a connection between the casing and the rear part of a sabot for a projectile, having on the rear part of the sabot a circumferential groove into which a rotating band of the casing (i.e. an area on the casing that contacts the rifling in a barrel from which the projectile is launched and which thus rotates or spins the projectile) protrudes, forming a connection between the casing and the rear part which both withstands the mechanical forces at launch and is gas-tight.

In a known sabot projectile of this type (see EP-B No. 0 072 584) the rear part of the sabot also possesses in addition to said circumferential groove a second circumferential groove, and the sabot casing also possesses in addition to said flange a second flange, the one flange used for sealing and other for attachment. The side walls of the circumferential groove receiving the flange for obturation are parallel to each other and forwardly inclined relative to the projectile axis at an angle of 75°. The side walls of the other circumferential groove are respectively forwardly and backwardly inclined at an angle of 75° relative to the projectile axis. The two circumferential grooves of the rear part of the sabot are separated by a circumferential rib.

However, this known connection between the casing and rear part of a sabot has the drawback of having to be broken again when the projectile emerges from the gun barrel since the sabot, i.e. the casing and rear portion have to separate from the projectile body. But such a breakable connection is unable to withstand great mechanical forces and high gas pressure when the projectile is launched.

BRIEF DESCRIPTION OF THE INVENTION

The present invention solves the problem of providing a connection between the casing and the rear part of a sabot that can cope with great mechanical forces and great gas pressure when the projectile is launched and does not need to be broken when the projectile emerges from the barrel.

The connection according to the invention is characterized in that the circumferential groove and the rotating band anchored therein have a dovetailed cross section, which prevents the rotating band from slipping out of the circumferential groove, and in that the rotating band is connected to the casing via a predetermined break point (line of weakness).

BRIEF DESCRIPTION OF THE DRAWINGS

One embodiment of the connection between the casing and the rear part of a sabot for a projectile is described in detail below with the help of the accompanying drawing, in which.

DETAILED DISCLOSURE OF THE PREFERRED EMBODIMENT

Figure 1:
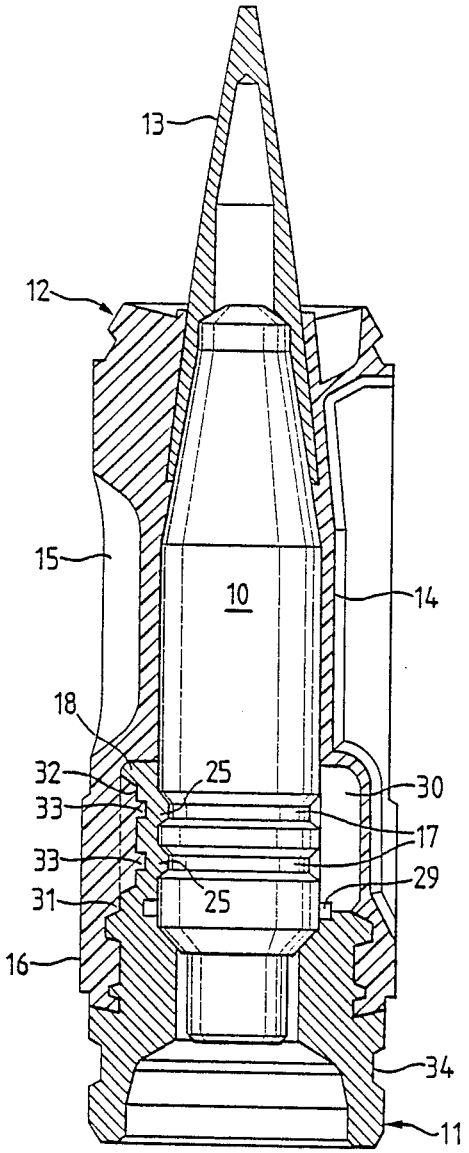
FIG. 1 shows a longitudinal section through a known sabot projectile.

In FIG. 1 the known sabot projectile comprises a projectile body 10, a rear part 11 and a casing 12. A ballistic cap 13 is fixed on the projectile body 10. To manufacture the projectile body 10 a heavy metal alloy is preferably used, particularly a tungsten alloy as is usual for such projectiles. The rear part of the sabot 11 is preferably made of light metal, and the casing 12 of plastic. The casing 12 conventionally comprises three segments joined together by means of suitable predetermined break points or lines of weakness 14. In FIG. 1 only a single predetermined break point 14 is illustrated. In addition the casing 12 has recesses 15 and a rotating band 16 which spins the projectile through contact with the barrel rifling. The projectile body 10 has two circumferential grooves 17, which serve to secure the rear part of the sabot 11 to the projectile body 10. This rear park or portion 11 exhibits six lugs 18, which protrude with projections 25 into the circumferential grooves 17 of the projectile body 10.

Though the sabot projectile design outlined so far is in itself known, it nevertheless seems necessary to draw attention to the following features, also known.

To enable the rear part of the sabot 11 to detach itself from the projectile body 10 when the projectile exits from the muzzle there is provided an interior channel 29 on the rear part of the sabot 11, forming a predetermined break point at which the lugs 18 can be broken off the rear part 11. These six lugs 18 are separated from each other by six slits 30. Thanks to the channel 29 and the slits 30 between the six lugs 18, once the projectile has left the gun barrel under the action of the centrifugal force produced by the rifling, the lugs 18 are able to bend so far outward that they break off and so no longer hold the projectile 10 with their toes 25 in the circumferential grooves 17. To facilitate this release of the projectile body 10 a further exterior circumferential channel 31 is provided on the rear part of the sabot 11, the thickness of the wall between the two channels 29 and 31 being just thick engough to allow the lugs 18 to easily break off under the centrifugal force.

To produce the projections 25, which of course cannot be made in the rear part of the sabot 11 until the projectile body 10 has been inserted, there is on each lug 18 a disk shaped recess 32. As soon as the projectile body 10 has been introduced into the rear part of the sabot 11, two rectangular recessed members 33 are each pressed into the floor of the disk shaped recesses 32, thereby forming the projections 25 which retain the projectile body 10 in the rear part of the sabot 11 since said projections 25 protrude into the grooves 17.

In addition the rear portion of the sabot 11 exhibits a further circumferential channel 34 which serves to secure a cartridge case, not shown in the drawing.

The demands made on the connection between the casing 12 and the rear part 11 of the sabot are increasing all the time, since the power of firearms is constantly increasing. The circumferential channel 34 is also nowadays deeper than it was hitherto, which means that the greater drag on the projectile 10 when it is expelled from the cartridge case causes increased gas pressure during the expulsion. The higher speed of delivery of the cartridge to the firearm puts greater mechanical stress on the connection between the rear part 11 and the casing 12. Appropriate design of the connection between the rear part 11 and casing 12 of the sabot, as according to the present invention, prevents propellant gases from penetrating between the casing 12 and the rear part 11 of the sabot.

Figure 2:
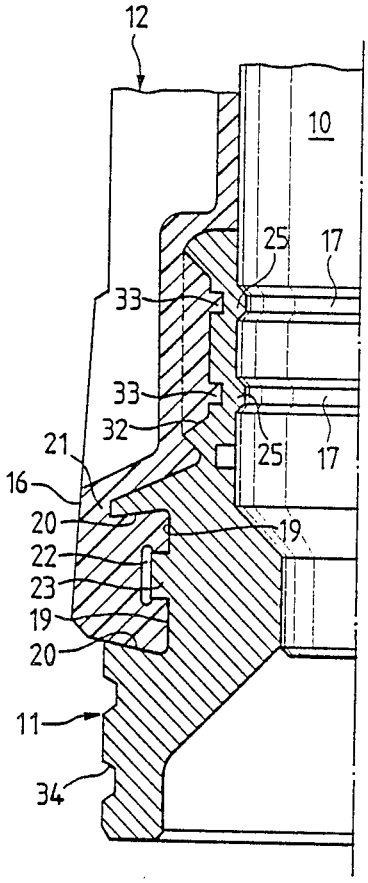
FIG. 2 shows a scaled up longitudinal section through the rear part of the sabot of the invention and a portion of its casing.

To this end the rear part of the sabot 11 shown in FIG. 2 exhibits a circumferential sealing groove 19 of dovetailed configuration, i.e. the two side walls 20 of said groove 19 are so inclined relative to the projectile axis as to make it far more difficult for the rotating band 16 to slip out by accident. As shown in FIG. 2, the rotating band 16 is joined to the casing 12 via a predetermined break point or line of weakness 21. On its interior the rotating band 16 exhibits a groove 22 into which a circumferential rib 23 of the rear part of the sabot 11 protrudes, thereby enhancing not only the seal between the rear part 11 and the casing 12 of the sabot, but also the engaging of the rear part 11 and casing 12. The predetermined break point 21, which extends across the entire circumference, allows the casing 12 of the sabot to detach itself from the rear part of the sabot 11 without the rotating band 16 once the projectile exits from the barrel. Thanks to this predetermined break point 21 the rotating band 16 can thus be secured sufficiently tightly to the rear part of the sabot 11. Thanks to this predetermined break point 21 the disintegration of the casing 12 is unimpeded. Thanks to the dovetailed configuration of the circumferential sealing and securing groove 19 the rotating band 16, or at least part thereof, is held, both in the gun barrel and once the projectile emerges from the barrel, on the rear part 11.

The outlined design of the sabot casing 12 having a rotating band 16 secured thereto via a predetermined break point 21 has the advantage of assuring a tight gas seal between the rear part 11 and the casing 12 of the sabot and assuring unimpeded separation of the casing 12 from the rear part 11 of the sabot when the projectile exits from the gun barrel.

While there are shown and described present preferred embodiments of the invention, it is to be distinctly understood that the invention is not limited thereto, but may be otherwise variously embodied and practiced within the scope of the following claims.

We claim:

1. A projectile and sabot arrangement comprising:

a projectile, a sabot comprising a casing and a rear part connected to the casing, said projectile being mounted in said sabot, an annular rotating band on the casing having a dovetail cross-section, a circumferential groove in the rear part having a dovetail cross-section corresponding to the dovetail cross-section of the annular rotating band and in which the annular rotating band is anchored by said dovetail cross-sections, said annular rotating band being connected to the rest of the casing by a predetermined break point, the casing and the rear part being thereby connected in gas-tight fashion and so as to withstand mechanical forces experienced during launching of the projectile and the annular rotating band being prevented by said dovetail section from slipping out of said circumferential groove.

2. A projectile and sabot arrangement as claimed in claim 1, in which the annular rotating band has a circumferential groove and the rear part has a circumferential rib engaging in said groove.

3. A projectile and sabot arrangement as claimed in claim 1, wherein:

following launching of the projectile at least part of the annular rotating band remains attached by said dovetail cross-section thereof with the rear part of the sabot whereas the casing is detached at the region of the predetermined break point from said annular rotating band.

* * * * *